United States Patent [19]

Bates

[11] 4,207,649

[45] Jun. 17, 1980

[54] CARPET CLEANING MACHINE

[76] Inventor: Jack A. Bates, 4654 Kenney Rd., Columbus, Ohio 43220

[21] Appl. No.: 882,407

[22] Filed: Mar. 1, 1978

Related U.S. Application Data

[63] Continuation-in-part of Ser. No. 665,269, Mar. 9, 1976, Pat. No. 4,087,881.

[51] Int. Cl.[2] ..... A47L 11/34

[52] U.S. Cl. ..... 15/319; 15/321; 15/353

[58] Field of Search ..... 15/319, 320, 321, 339, 15/353

[56] References Cited

U.S. PATENT DOCUMENTS

| | | | |
|---|---|---|---|
| 3,496,592 | 2/1970 | Jones | 15/321 |
| 3,694,263 | 9/1972 | Korn | 15/321 X |
| 3,736,619 | 6/1973 | Zamboni | 15/320 X |
| 3,774,260 | 1/1973 | Emus | 15/321 |
| 3,902,219 | 9/1975 | Jones | 15/321 X |
| 4,080,104 | 3/1978 | Brown | 15/353 X |

*Primary Examiner*—Christopher K. Moore

[57] ABSTRACT

A carpet cleaning machine wherein cleaning fluid is continuously dispensed to an in-place carpet from manually manipulatable tools and wherein dirty fluid is continuously picked up from the carpet and conveyed to a dirty fluid collecting chamber. The machine is characterized by an automatic discharge means for the dirty fluid collecting chamber whereby dirty fluid is automatically cycled out of the collecting chamber and delivered to a disposal location as required. The machine is further characterized by an automatic cleaning fluid supply system.

14 Claims, 7 Drawing Figures

CARPET CLEANING MACHINE

REFERENCE TO CO-PENDING APPLICATION

This application is a continuation-in-part of my co-pending application Ser. No. 665,269 filed Mar. 9, 1976, and now U.S. Pat. No. 4,087,881, issued May 9, 1978.

BACKGROUND OF THE INVENTION

This invention relates generally to carpet cleaning machines for in-place carpets and more particularly to such an apparatus which is adapted to continuously dispense cleaning fluid to and pick up dirty solution from the carpets.

SUMMARY OF THE INVENTION

In general, the present invention comprises a carpet cleaning machine of relatively high capacity which is particularly adapted to be mounted in a van for transportation to the working site. The machine is self-contained in that it includes a frame on which are mounted the various components including a cleaning fluid reservoir from which heated cleaning fluid is dispensed to the carpet and a dirty fluid collecting chamber into which is delivered dirty fluid picked up from the carpet.

More particularly, the machine comprises a novel automatic discharge system for the dirty fluid collecting chamber which system includes a discharge controller that functions to automatically cycle dirty fluid from the collecting chamber to a remote disposal location.

As an other aspect of the present invention, the above mentioned discharge system includes a discharge pump that is operatively responsive to the occurance of predetermined upper and lower fluid levels in the collecting chamber such that surface lint and bottom sediment are not drawn into said discharge pump.

As an other aspect of the present invention, the machine includes a novel automatic ignition cut-off system that is adapted to automatically stop the carpet cleaning machine when the dirty fluid collecting chamber becomes full.

As another aspect of the present invention, the machine includes a novel cleaning solution control system which system functions to automatically cycle replenishment quantities of cleaning solution to a holding tank, with such solution being in the form of heated water and liquid soap.

As another aspect of the present invention, the cleaning solution control system is adapted to meter controlled amounts of soap solution to a continuously delivered supply of heated cleaning water.

As still another aspect of the present invention this machine includes a novel automatic ignition cut-off system that is adapted to preclude starting of the carpet cleaning machine unless a sufficient quantity of cleaning solution is present in the holding tank.

It is therefore, an object of the present invention to provide a carpet cleaning machine that includes a novel automatic discharge system for intermittantly draining the dirty fluid collecting chamber with the discharge cycles being automatically started and stopped as required.

It is another object of the present invention to provide a carpet cleaning machine that comprises an automatic discharge system for the dirty fluid collecting chamber. Which system includes a discharge pump that is isolated from the contaminating effects of surface lint and bottom sediment which have been delivered from the dirty carpet to the collecting chamber.

It is another object of the present invention to provide a carpet cleaning machine that includes means for automatically stopping the machine responsive to filling of the dirty fluid collecting chamber.

It is another object of the present invention to provide a novel carpet cleaning machine adapted for the controlled metering of soap solution to heated cleaning water as the latter is continuously delivered to the tool of the machine.

It is another object of the present invention to provide a carpet cleaning machine of the type described which includes a holding tank for a heated solution of cleaning fluid and water which tank is provided with an automatically controlled valve means for maintaining a supply of mixed hot water and soap solution with such valve being responsive to the demand imposed by the release of cleaning solution to the carpet.

It is another object of the present invention to provide a carpet cleaning machine that includes means for automatically preventing starting of the machine unless a sufficient supply of heated cleaning solution is present in the holding tank.

It is another object of the present invention to provide an apparatus of the type described wherein the holding tank means automatically maintains a supply of heated cleaning solution when the machine is transferred from one job to another such that the machine is ready for immediate use.

Further objects and advantages of the present invention will be apparent from the following description, reference being had to the accompanying drawings wherein preferred forms of embodiments of the invention are clearly shown.

DESCRIPTIONS OF THE PREFERRED EMBODIMENT

Figure 1:
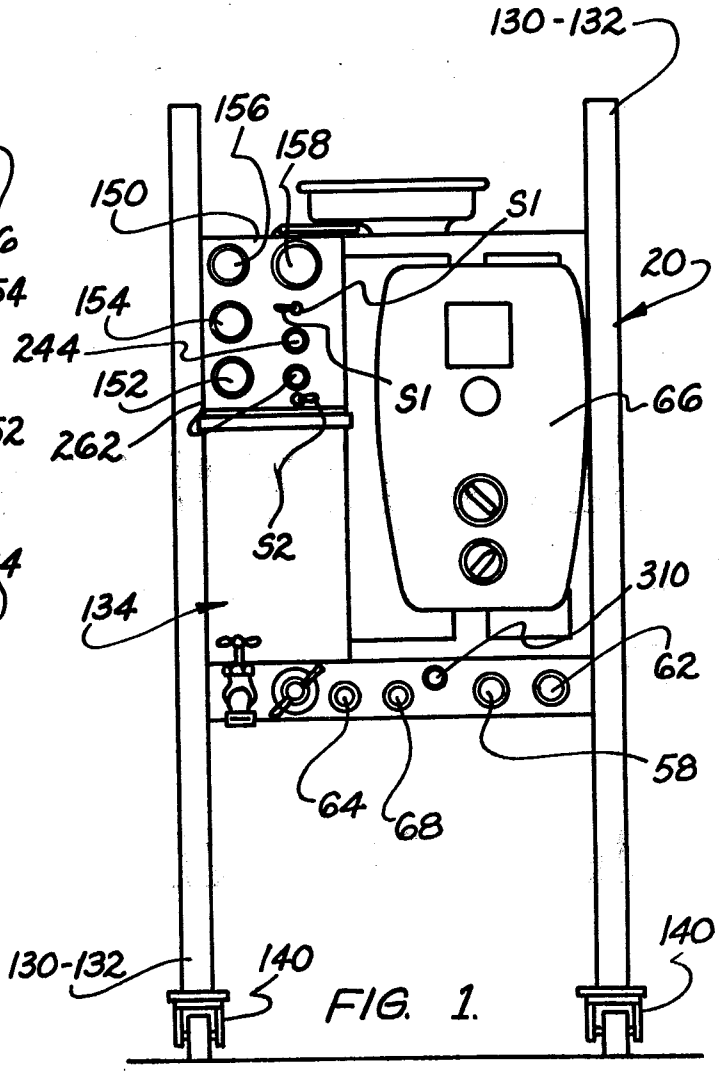
FIG. 1 is a front elevational view of a carpet cleaning machine constructed in accordance with the present invention.

Referring in detail to the drawings, the carpet cleaning machine constructed in accordance with the present invention is illustrated in FIGS. 1–4 and includes a frame means indicated generally at 20. The frame means serves to mount all of the components of the machine which in general function to deliver cleaning solution to a carpet cleaning tool indicated generally at 22, FIG. 5, in turn applies the solution to a carpet 26 and which also functions to pick up the dirty cleaning fluid extracted from the carpet.

Referring particularly to FIGS. 1–4, frame means 20 is provided with detachable legs 130–132 with such legs being removeable from transverse frame members 135 and 136 by detaching fasteners 138. With the legs removed, the machine becomes compactly adapted to be mounted on the floor of a van type light truck or other vehicle. Also, it will be noted that the lower ends of legs 130–132 are provided with casters 140.

Figure 3:
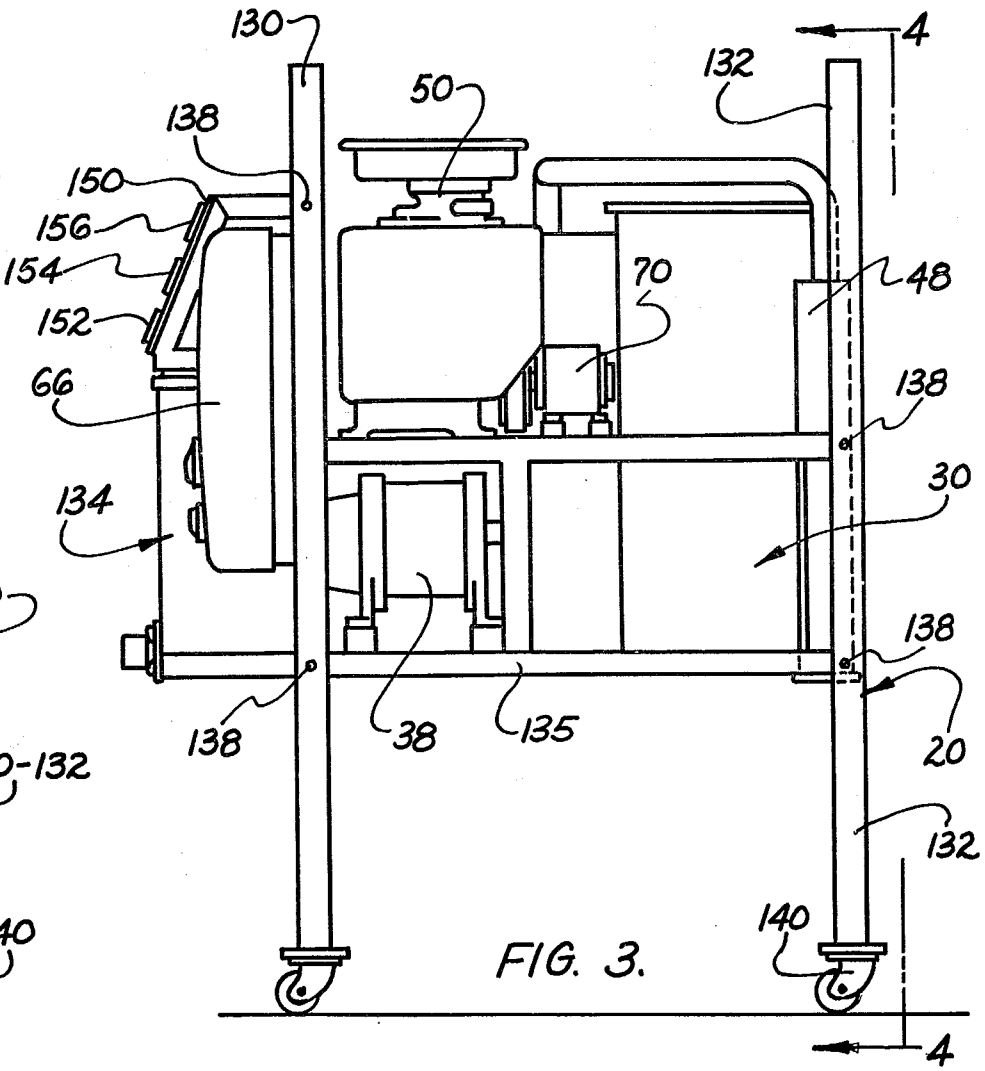
FIG. 3 is a rear elevational view of the machine of FIG. 1.
Figure 4:
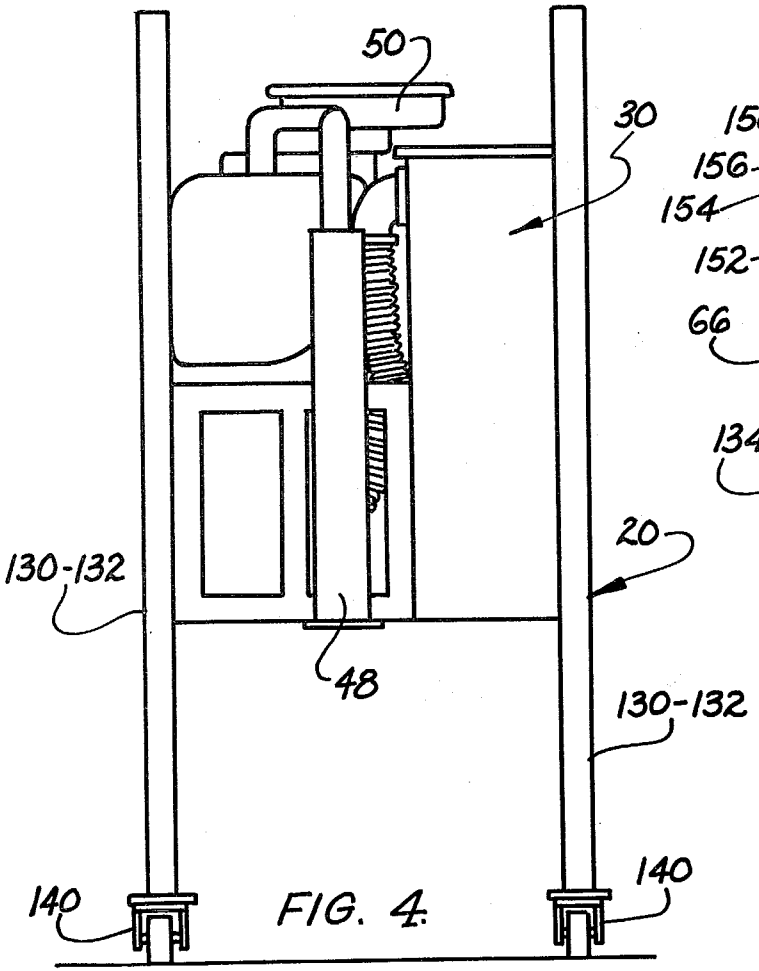
FIG. 4 is a right side elevational view of the machine of FIG. 1.
Figure 5:
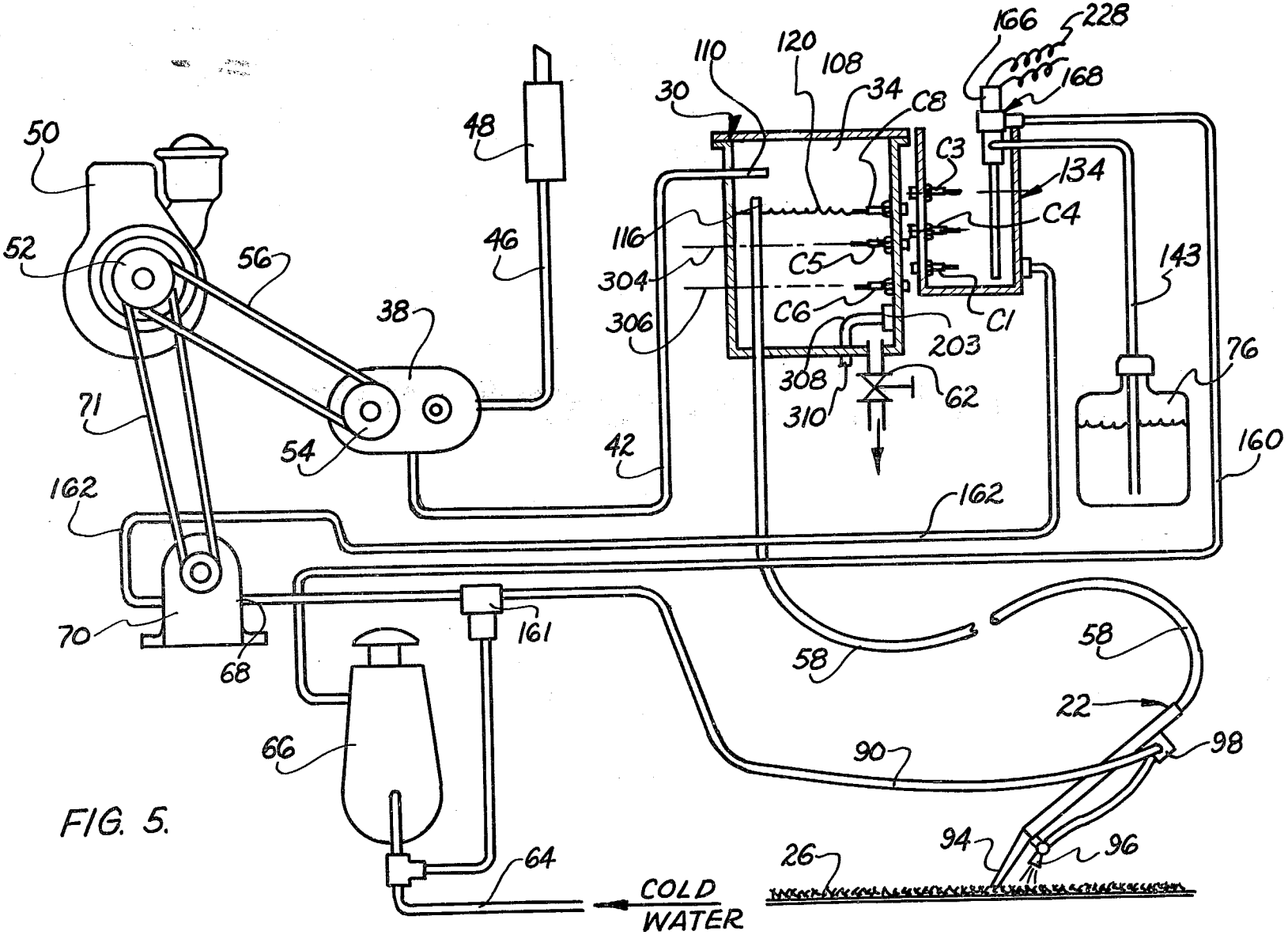
FIG. 5 is a diagrammatic view showing the fluid flow system of the machine of the preceding figures.

As is best seen in FIGS. 1, 3, and 4, the frame means supports a dirty fluid collecting means indicated generally at 30 which consists of a tank that forms a dirty fluid collecting chamber 34 seen in FIG. 5.

As seen in FIG. 5 chamber 34 is connected to a vacuum pump 38 by a vacuum line 42 with the vacuum pump being vented to the atmosphere by an exhaust line 46 that inlcudes a muffler 48.

Figure 2:
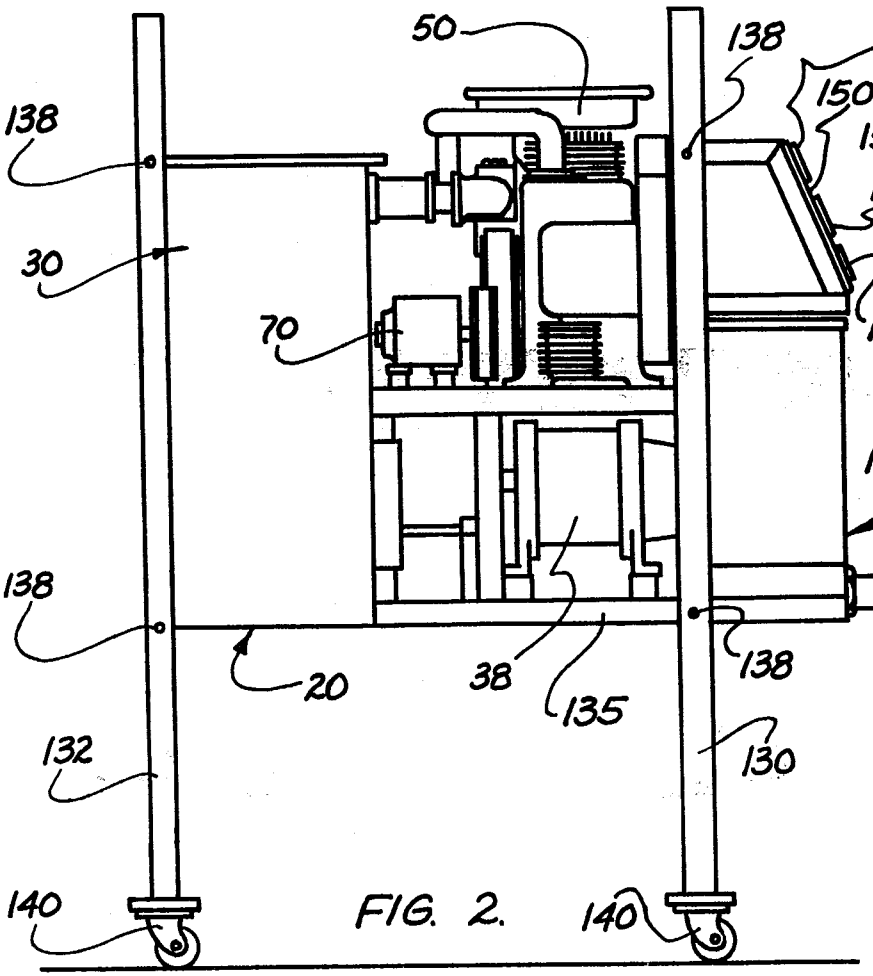
FIG. 2 is a left side elevational view of the machine of FIG. 1.

With reference to FIGS. 2 and 5, vacuum pump 38 is driven by a gasoline engine 50 via the driving pulley 52, driven pulley 54, and V-belt 56.

The water pick up system further includes a flexible line 58 which connects the tool 22 to the dirty fluid chamber 34.

It should be mentioned that dirty fluid collecting chamber 34 is provided with a manually operated drain valve 62. Chamber 34 is further provided with an automatic dirty fluid discharge means as will be described in detail later herein.

With reference to FIG. 5, tool 22 includes a dirty fluid inlet 94, a cleaning solution outlet 96 and a shut-off valve 98 is mounted on the tool between outlet 96 and flexible inlet line 90.

In general, a hot solution of cleaning fluid is at all times available to the tool 22 from a holding tank 134, FIG. 5, with the solution being delivered via line 162, pump 70, pressure relief valve 161, flexible line 90, and manual solution shut-off valve 98, the latter being mounted on the handle of tool 22 such that when the operator actuates shut-off valve 98 hot cleaning fluid solution is delivered to the carpet via solution outlet 96.

OPERATION OF THE CLEANING FLUID SUPPLY SYSTEM

Figure 6:
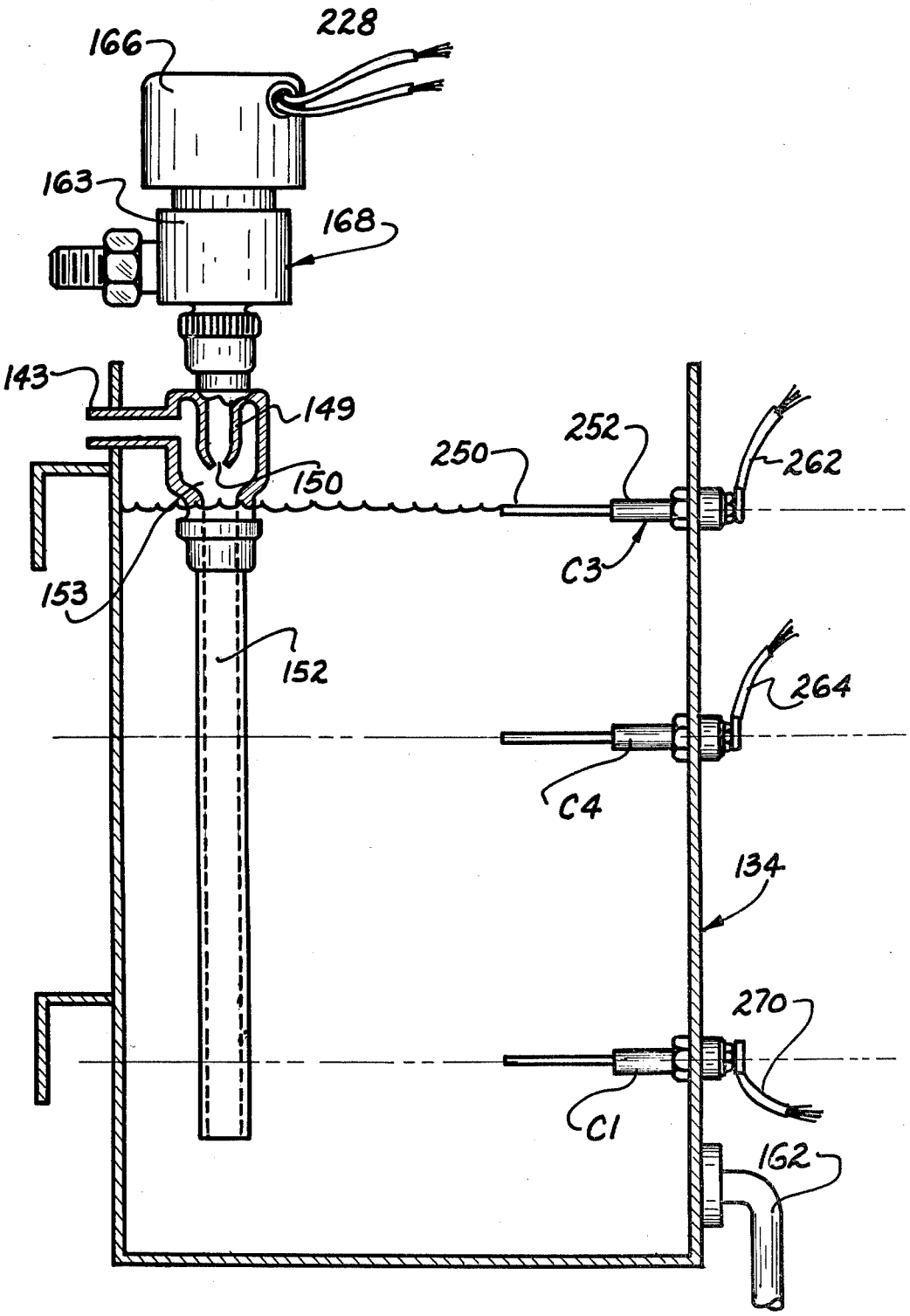
FIG. 6 is a side sectional view of a holding tank and venturi valve comprising a portion of the modified system of FIG. 5.

Reference is made to FIGS. 5 and 6 for purposes of describing the hot cleaning solution supply system that includes a holding tank indicated generally at 134 for a heated solution of cleaning fluid and water.

Cold water from a pressurized supply such as a household tap passes via line 64 to the inlet of a hot water heater 66 and then through line 160 to the hot water inlet of a solution flow control valve 168.

FIG. 6 is an enlarged view of a holding tank 134 showing solution flow control valve 168 which includes a solenoid 166 for opening and closing valve elements, not illustrated, which are enclosed in a valve housing 163. Opening of the valve elements connects a hot water inlet line 160 with a mixing chamber inlet tube 149 that includes a venturi orifice 150 located in a mixing chamber 153 that communicates with a soap inlet line 143.

Figure 7:
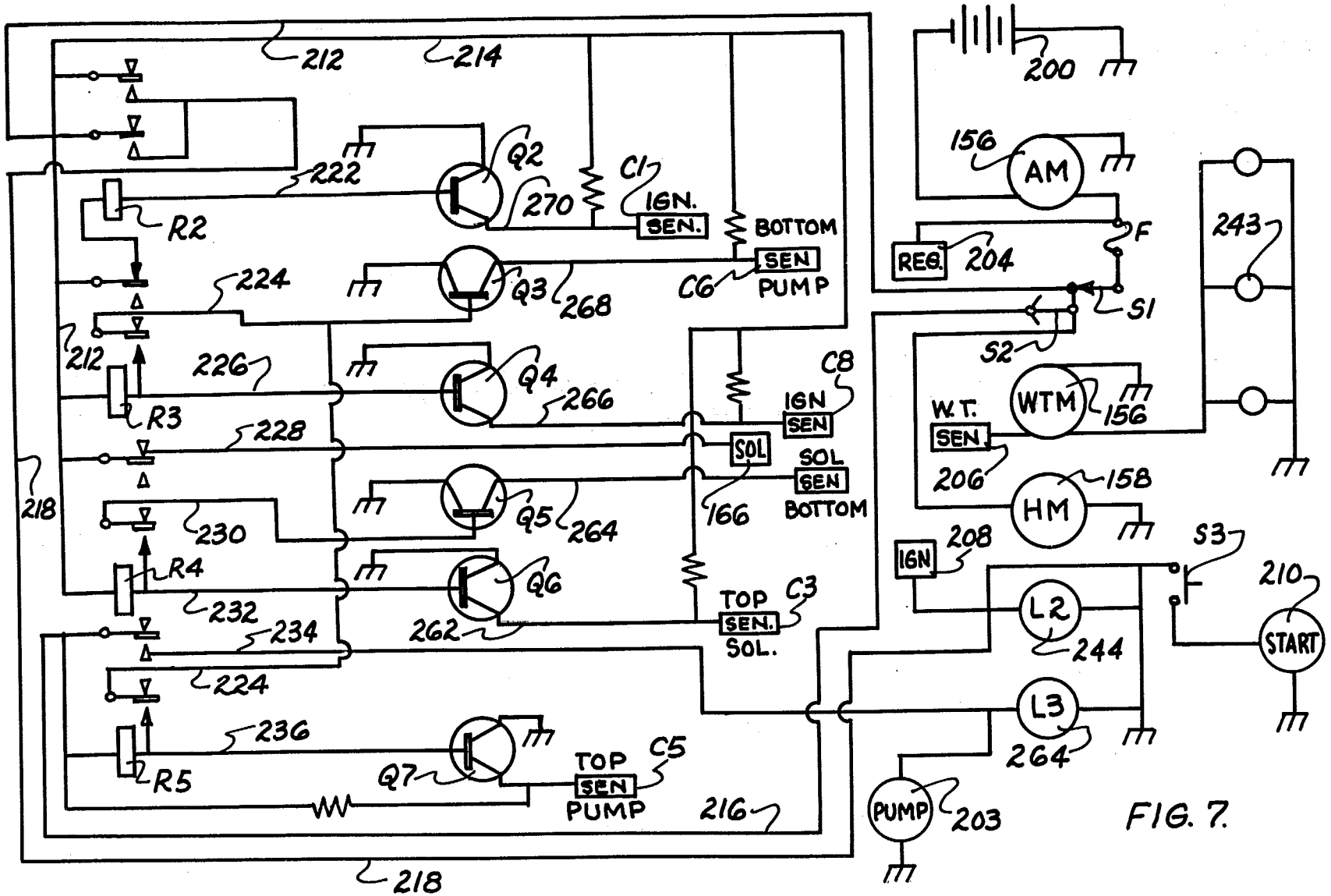
FIG. 7 is a diagrammatic view of an electrical circuit used in conjunction with the components of the fluid flow system of FIG. 5.

Referring next to the control circuit of FIG. 7, when the operator turns on power switch S1, then solenoid 166 is energized via wire 212, the normally closed points of relay R4, and wire 228. With solonoid 166 energized, solution control valve 168, FIG. 6, is open and holding tank 134 continues to receive solution until the level reaches top solution sensor C3. It should now be mentioned that sensor C3 consists of a stainless steel probe 250 that extends through a sensor body 252 in insulated relationship therewith, with probe 250 having its outer end secured to wire 262 which leads to transistor Q6 as seen in the circuit diagram of FIG. 7. It should further be mentioned that all of the other sensors C1, C8, C4, C5 and C6 are of identical construction and function to actuate their respective transistors when the solution engages the probe tip 250 of the sensor. When the solution level in holding tank 134 reaches top solution sensor C3, then transistor Q6 energizes relay R4 which disconnects solenoid 166 from wire 212.

This closes solution valve 168 and terminates the flow of solution to the holding tank. Solution valve 168 stays closed when solution is withdrawn from the tank via line 162 until the solution level falls to a level where it leaves bottom solution sensor C4. During this period relay R4 is maintained energized by transistor Q5 connected to bottom solution sensor C4 by wire 264, and to relay R4 by wire 230. When the solution leaves sensor C4 its transistor Q5 deenergizes relay R4 which in turn energizes solenoid 166 and opens solution control valve 168 whereby the filling portion of the cycle is repeated.

It will now be understood the above solution control cycle for holding tank 134 will continue to repeat so long as power switch S1 is maintained in the position "on".

OPERATION OF THE DIRTY FLUID COLLECTING SYSTEM

Referring to FIGS. 5 and 7, the machine is provided with a dirty fluid collecting system indicated generally at 30 which includes a collecting chamber 34 for receiving dirty solution picked up from the carpet as previously described. The collecting chamber 34 is provided with an automatic pump-out apparatus and associated control system which can be used when desired, and which includes a discharge pump 203, FIG. 5 which exhaustes dirty fluid via oulet line 308.

In general discharge pump 203 is turned off and on as required to maintain the dirty fluid level between upper and lower limits, indicated by the datums 304 and 306 in FIG. 5 with the sensors C5 and C6 being mounted to the chamber wall at these locations.

When the operator desires to use the automatic pump-out control then an automatic pump-out switch S2 is turned on. When the dirty solution engages the top pump sensor C5 then relay R5 is energized via transistor Q7 and wire 236. This energizes and starts the motor of pump 203 via wire 234 and the normally open contacts of relay R5, pump 203 then discharges dirty solution via line 308 until the solution level falls below a bottom pump sensor C6. It should be mentioned that relay R5 is held energized by transistor Q3 until the solution leaves bottom pump sensor C6. At this time relay R5 is deenergized and pump 203 is stopped terminating the pump-out portion of the dirty solution cycle.

As the operator continues to pick up dirty solution from the carpet with tool 22, the dirty solution chamber 34 will start to refill via line 58, and the pump-out cycle will continue to repeat, so long as pump-out switch S2 is in the "on" position.

It should now be mentioned that with the above described operation, as well as with the submerged location of discharge pump 203 the submerged intake of the pump will at all times be isolated from the surface level of the bath in dirty fluid chamber 34 as well as the bottom of the chamber whereby the pump is at all times isolated from the surface lint which accumulates at the surface 120 as well as from sediment which collects on the bottom of the chamber below the pump intake.

It should also be mentioned that dirty fluid collecting chamber 34 can at any time be manually dumped by the valve 62 shown in FIG. 5.

ENGINE IGNITION CUT-OFF CONTROL SYSTEM

With continued reference to FIG. 7, the electric control circuit includes a safety controller for protecting solution delivery pump 70 from damage which occurs when these pumps are operated without fluid present, such safety controller includes automatic means for preventing starting of engine 50 when there is an inadequate supply of cleaning solution present in holding tank 134. In addition the control circuit is further provided with a second safety controller adapted to automatically stop engine 50 during the cleaning operation when the dirty water level becomes too high in collecting chamber 34, which could occur in the event the automatic pump-out cycle is manually turned off at switch S2 as previously described. Such automatic prevention of too high a water level in the collecting chamber is important in that the water being collected must not enter the vacuum inlet 110 of vacuum line 42 leading to blower 38.

In general, both of the above described engine cut-off functions are accomplished by breaking the circuit to the conventional ignition system for the engine 50 with such ignition system being represented diagrammatically at 208 in the circuit diagram of FIG. 7. With continued reference to FIG. 7, when the cleaning solution in holding tank 134 is sufficient to supply pump 70 and the solution conduits 162 and 90 leading to tool 22, then ignition control sensor C1 the lowermost sensor in the holding tank, will be covered with fluid thereby energizing transistor Q2 via wire 270 which in turn energizes relay R2 via wire 22. As a result the normally open contacts of relay R2 are closed, thereby connecting wires 212 and 218, which in turn connect engine ignition 208 to battery 200. It will now be understood, that engine 50 cannot be started unless the cleaning solution level is above ignition control sensor C1 in the solution holding tank.

Referring again to the control circuit of FIG. 7 engine 50 is automatically stopped responsive to too high a dirty solution level in chamber 34, FIG. 5, when the dirty solution contacts an ignition control sensor C8, the upper most sensor in dirty fluid collecting chamber 34. When the liquid reaches sensor C8, then transistor Q4 energizes relay R3 which in turn breaks the circuit to relay R2. This disconnects wire 218 from wire 212 whereby engine ignition 208 is deengergized. It will be seen from FIG. 7 that relay R3 remains energized until the dirty solution level is dropped below ignition control sensor C6. This is accomplished either by manually draining collecting chamber 34 at manual drain valve 62, or by instituting the automatic pump-out cycle by turning on the automatic pump-out switch S2 as previously described.

Referring to FIGS. 1 and 2, a control panel 150 is provided on the front of the machine and includes various switches and meters including a vacuum gauge 152 for the vacuum system and a solution temperature gauge 154 for indicating the temperature of the solution in holding tank 134. The control panel further includes ammeter 156 as well as an engine hour meter 158, ignition switch S1, ignition "on" light 244, auto-discharge switch S2, and auto-discharge light 262.

While the forms of embodiments of the present invention as herein disclosed constitute preferred forms, it is to be understood that other forms might be adopted.

What is claimed is:

1. A carpet cleaning machine comprising, in combination, a frame; a dirty fluid collecting means mounted on said frame and including a dirty fluid collecting chamber provided with an inlet and an outlet; a cleaning solution reservoir mounted on said frame and including a reservoir inlet and reservoir outlet; a vacuum pump mounted on said frame and including a pump inlet connected to said collecting chamber outlet; water heater means mounted on said frame and including a cold water inlet and a hot water outlet; cleaning solution pump means including a cleaning solution pump inlet communicating with said cleaning fluid reservoir outlet and a cleaning solution pump outlet; a cleaning solution flow controller including a flow controller intlet communicating with said hot water outlet and a flow controller outlet communicating with said reservoir inlet; a manually manipulatable carpet cleaning tool including a tool outlet for dispensing mixture of water and cleaning solution on a carpet and tool inlet for collecting dirty fluid from the carpet; a flexible cleaning solution conduit connecting said tool outlet with said cleaning solution pump outlet; a flexible dirty fluid conduit connecting said tool inlet with said dirty fluid collecting chamber inlet; power means for driving said pumps; vacuum cut-off means for terminating the suction at said tool inlet, said vacuum cut off means including a safety controller for automatically terminating operation of the power means and vacuum pump responsive to the rising of dirty fluid to a predetermined fluid level in said dirty fluid collecting chamber; and automatic discharge means for said dirty fluid collecting chamber, said discharge means including a discharge controller for switching said discharge means to an operative condition responsive to the rising of dirty fluid to a predetermined upper fluid level, and for switching said discharge means to an inoperative condition responsive to the falling of dirty fluid to a predetermined lower fluid level.

2. The carpet cleaning machine defined in claim 1 wherein said automatic discharge means includes an upper fluid level sensor located at a predetermined upper fluid level and a lower fluid level sensor located at a predetermined lower fluid level in said collecting chamber, and wherein said discharge controller automatically starts and stops discharge cycles between said upper and lower fluid levels.

3. The carpet cleaning machine defined in claim 1 wherein said automatic discharge means includes a discharge pump inlet communicating with the dirty fluid collecting chamber at a pump-out location therein; a fluid responsive upper sensor for starting said pump responsive to the rising of the fluid level to the upper sensor; a fluid responsive lower sensor for stopping the pump responsive to the falling of the fluid level to the lower sensor.

4. In a carpet cleaning machine of the type that includes a dirty fluid collecting chamber, holding tank means for a supply of heated cleaning solution, and a manually manipulateable carpet cleaning tool for dispensing said cleaning solution to and for picking up dirty fluid from a carpet, the combination of automatic discharge means for said dirty fluid collecting chamber, said discharge means including a discharge controller for switching said discharge means to an operative condition responsive to the rising of dirty fluid to a predetermined upper fluid level and for switching said discharge means to an inoperative condition responsive to the falling of dirty fluid to a predetermined lower fluid level; and a safety controller for automatically terminating the delivery of dirty fluid to the collecting chamber when the dirty fluid rises to an overflow level above said predetermined upper fluid level.

5. The carpet cleaning machine defined in claim 4 wherein said automatic discharge means includes an upper fluid level sensor located at a predetermined upper fluid level and a lower fluid level sensor located at a predetermined lower fluid level in said collecting chamber, and wherein said discharge controller automatically starts and stops discharge cycles between said upper and lower fluid levels.

6. The carpet cleaning machine defined in claim 4 wherein said automatic discharge means includes a discharge pump including a pump inlet communicating with said collecting chamber, and wherein said discharge controller automatically starts and stops said discharge pump.

7. In a carpet cleaning machine of the type that includes a dirty fluid collecting chamber, holding tank means for a heated cleaning solution, and a manually manipulatable carpet cleaning tool for dispensing cleaning solution on a carpet and for picking up dirty fluid from the carpet, the combination of automatic solution level control means for said holding tank means, said solution level control means including a switch means for switching said solution level control means to an operative condition responsive to the falling of solution to a predetermined lower solution level, and for switching said solution level control means to an inoperative condition responsive to the rising of solution to a predetermined upper solution level; and pump means for delivering cleaning solution from the holding tank means to the carpet cleaning tool; and a safety controller for automatically preventing operation of said pump means when the solution level in the holding tank means is initially at an undesireably low level.

8. In a carpet cleaning machine of the type that includes a dirty fluid collecting chamber, holding tank means for a heated cleaning solution, and a manually manipulatable carpet cleaning tool for dispensing cleaning solution on a carpet and for pickeing up dirty solution from the carpet, the combination of automatic solution level control means for said holding tank means, said solution level control means including a switch means for switching said solution level control means to an operative condition responsive to the falling of solution to a predetermined lower solution level, and for switching said solution level control means to an inoperative condition responsive to the rising of solution to a predetermined upper solution level; a solution flow control valve means including a mixing chamber, a water inlet, water outlet communicating with said mixing chamber and a soap solution inlet communicating with said mixing chamber, said flow control valve means being actuated by movement of said solution level control means to a corresponding condition.

9. In a carpet cleaning machine of the type that includes a dirty fluid collecting chamber, holding tank means for a heated cleaning solution, and a manually manipulatable carpet cleaning tool for dispensing cleaning solution on a carpet and for picking up dirty fluid from the carpet, the combination of pump means for delivering a flow of cleaning solution from said holding tank means to said carpet cleaning tool, an engine for driving said pump, said engine including an ignition switch; and a safety switch that is opened responsive to the falling of the solution level in said holding tank means past and undesireably low level, said safety switch being in circuit with said ignition switch to prevent energization of the ignition when the solution level in the holding tank means is initially at said undesireably low level.

10. In a carpet cleaning machine of the type that includes a dirty fluid collecting chamber, holding tank means for a heated cleaning solution, and a manually manipulatable carpet cleaning tool for dispensing cleaning solution on a carpet and for picking up dirty fluid from the carpet, the combination of automatic solution level control means, said solution level control means being operatively responsive to the rising and falling of the solution level to predetermined upper and lower levels in said holding tank means; pump means for delivering a flow of cleaning solution from said holding tank means to said carpet cleaning tool, an engine for driving said pump, said engine including an ignition switch; and a safety switch that is closed and opened, respectively responsive to the rising and falling of the solution level in said holding tank means past an undesirably low level, said safety switch being in circuit with said ignition switch to prevent energization of the ignition when the solution level in the holding tank means is initially at said undesireably low level.

11. In a carpet cleaning machine of the type that includes a dirty fluid collecting chamber, holding tank means for a supply of heated cleaning solution, and a manually manipulatable carpet cleaning tool for dispensing said cleaning solution to and for picking up dirty fluid from a carpet, the combination of automatic discharge means for said dirty fluid collecting chamber, said discharge means including a discharge controller for switching said discharge means to an operative condition responsive to the rising of dirty fluid to a predetermined upper fluid level, and for switching said discharge means to an inoperative condition responsive to the falling of dirty fluid to a predetermined lower fluid level; automatic solution level control means for said holding tank means, said solution level control means including a switch means for switching said solution level control means to an operative condition responsive to the falling of solution to a predetermined lower solution level, and for switching said solution level control means to an inoperative condition responsive to the rising of solution to a predetermined upper solution level; and pump means for delivering cleaning solution from the holding tank means to the carpet cleaning tool; and a safety controller for automatically preventing operation of said pump means when the solution level in the holding tank means is initially at an undesireably low level.

12. The carpet cleaning machine defined in claim 11 wherein said solution level control means comprises a solution flow control valve means including a mixing chamber, a water inlet, a water outlet communicating with said mixing chamber, said flow control valve means being actuated by movement of said solution level control means to a corresponding condition.

13. In a carpet cleaning machine of the type that includes a dirty fluid collecting chamber, holding tank means for a supply of heated cleaning solution, and a manually manipulatable carpet cleaning tool for dispensing said cleaning solution to and for picking up dirty fluid from a carpet, the combination of automatic discharge means for said dirty fluid collecting chamber, said discharge means including a discharge controller operatively responsive to the rising and falling of fluid between predetermined upper and lower levels in said collecting chamber; pump means for delivering a flow of cleaning solution from said holding tank means to said carpet cleaning tool, an engine for driving said pump, said engine including an ignition switch; and a safety switch that is closed responsive to the falling of the solution level in said holding tank means past an undesirably low level, said safety switch being in circuit with said ignition switch to prevent energization of the ignition when the solution level in the holding tank means is initially at said undesireably low level.

14. The carpet cleaning machine defined in claim 11 that comprises, an engine for driving said pump means, said engine including an ignition switch; and a safety switch that is closed and opened, respectively responsive to the rising and falling of the solution level in said holding tank means past on undesireably low level, said safety switch being in circuit with said ignition switch to prevent energization of the ignition when the solution level in the holding tank means is initially at said undesireable low level.

* * * * *